United States Patent [19]

Yang

[11] Patent Number: 4,962,681

[45] Date of Patent: Oct. 16, 1990

[54] MODULAR MANUAL ELECTRIC APPLIANCE

[76] Inventor: Tai-Her Yang, 5-1 Taipin St., Si-Hu Town, Dzan-Hwa,, Taiwan

[21] Appl. No.: 277,651

[22] Filed: Nov. 29, 1988

Related U.S. Application Data

[63] Continuation-in-part of Ser. No. 270,466, Nov. 9, 1988, abandoned, which is a continuation of Ser. No. 156,027, Feb. 16, 1988, abandoned.

[51] Int. Cl.[5] ..... B25B 21/00

[52] U.S. Cl. ..... 81/54; 7/167; 408/20

[58] Field of Search ..... 87/54, 177.1, 177.8; 173/12, 148, 163, 46, 47; 7/158, 167; 279/14; 408/20, 21, 124

[56] References Cited

U.S. PATENT DOCUMENTS 1,805,005 5/1931 Phillips ..... 7/167
3,550,486 12/1970 Edwards ..... 81/177.8 X
3,603,782 9/1971 Wortmann ..... 7/167 X
3,783,955 1/1974 Gill ..... 408/20 X
4,522,270 6/1985 Kishi ..... 87/177.1 X

*Primary Examiner*—James G. Smith
*Attorney, Agent, or Firm*—Leonard Bloom

[57] ABSTRACT

A modular electric appliance comprises an appliance module (202) which carries contacts (220) on its exterior and may be inserted within a tubular portion (103) of the handle portion (106) of the appliance. Preferably the appliance module carries two different appliance portions at its opposite ends such as a drill chuck (213) and a socket wrench (212). If these appliance portions are rotary tools, they may be driven by a common electric motor (201). The appliance module is energized from annular contacts (208) formed on the interior surface of the tubular portion (103). In an alternative embodiment, the module (202) may carry three or more contacts (220) so disposed that only one pair of these contacts is energized according to the orientation of the modular when it is inserted into the tubular portion (103). This ensures that only the appliance portion protruding from the tubular portion (103) is energized.

4 Claims, 5 Drawing Sheets

MODULAR MANUAL ELECTRIC APPLIANCE

CROSS REFERENCE TO RELATED APPLICATIONS

The present application is a continuation-in-part of application Ser. No. 270,466 filed Nov. 9, 1988, which in turn is a file-wrapper continuation of Ser. No. 156,027 filed Feb. 16, 1988 which applications are copending herewith, both now abandoned, and the disclosures of which are incorporated herein by their entirety.

The present invention relates to manual electric appliances such as electric drills for example.

A variety of hand held electric tools are available, such as electric drills, electric screw drivers, electric socket wrenches and the like, and since such tools tend to be relatively bulky and heavy it is tiring and inconvenient to carry a set of different hand held electric tools around a site.

In order to overcome this problem, the invention provides a hand held electric appliance comprising a handle portion and characterised by a generally tubular portion extending therefrom and carrying a plurality of power supply contacts on its interior, an electric appliance module being releasable mounted within such tubular portion and incorporating an electric appliance portion which is connected to further contacts located on the exterior of the appliance module, which further contacts engage said power supply contacts within said tubular portion.

This enables a kit containing one handle portion with its tubular extension and a plurality of electric appliance modules to replace a set of conventional hand held electric appliances. When a different function is required, the electric appliance module within the tubular portion maybe replaced by the user with an appropriate different module.

In a preferred embodiment of the invention, the appliance module carries a plurality of electric appliance portions and can be mounted within a tubular portion in a selected one of a plurality of orientations so as to expose a selected of said appliance portions and house another of said appliance portions according to the orientation selected.

These appliance portions may be high-speed and rotary tools respectively and may be driven by a common electric motor located within their appliance module.

Further advantageous preferred features are defined in the dependent claims.

Preferred embodiments of the invention are described below by way of example only with reference to FIGS. 1 to 18 of the accompanying drawings, of which:

Figure 6:
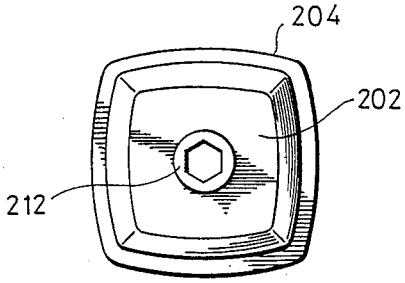
Figure 7:
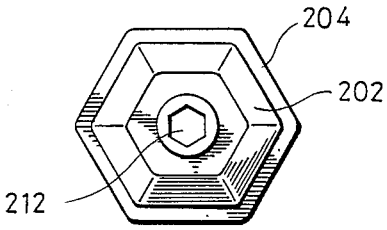
Figure 8:
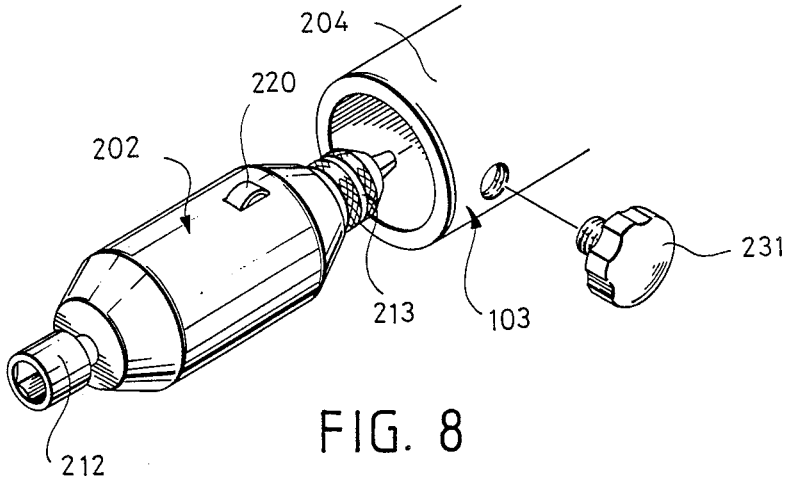
Figure 9:
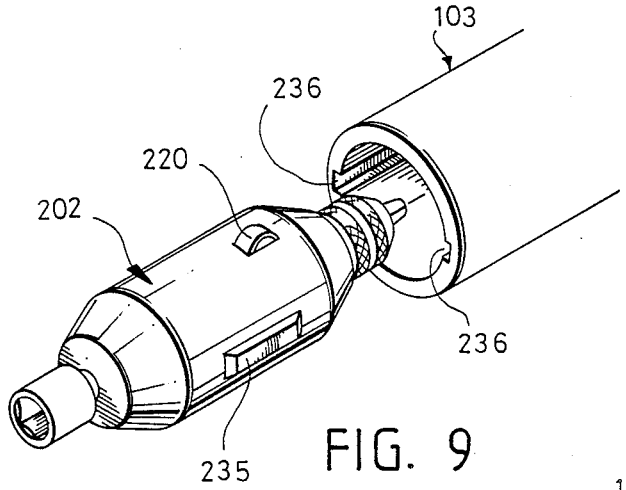
Figure 10:
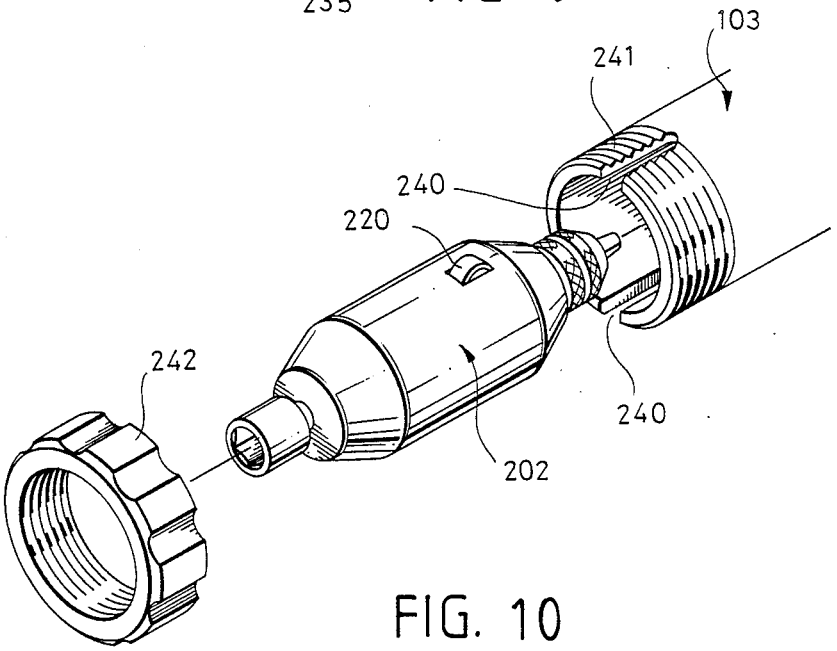
Figure 11:
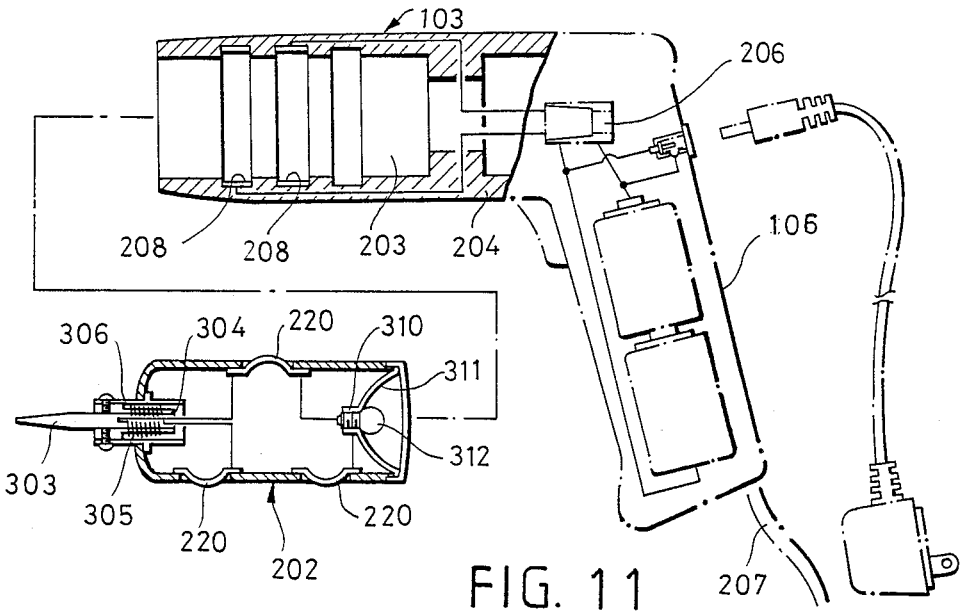
Figure 12:
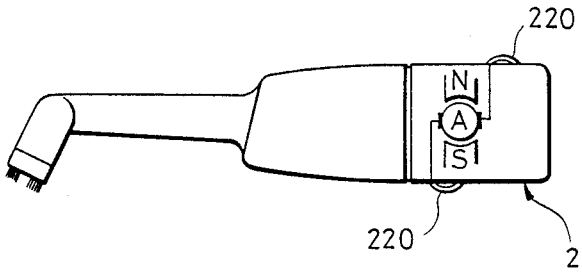
Figure 13:
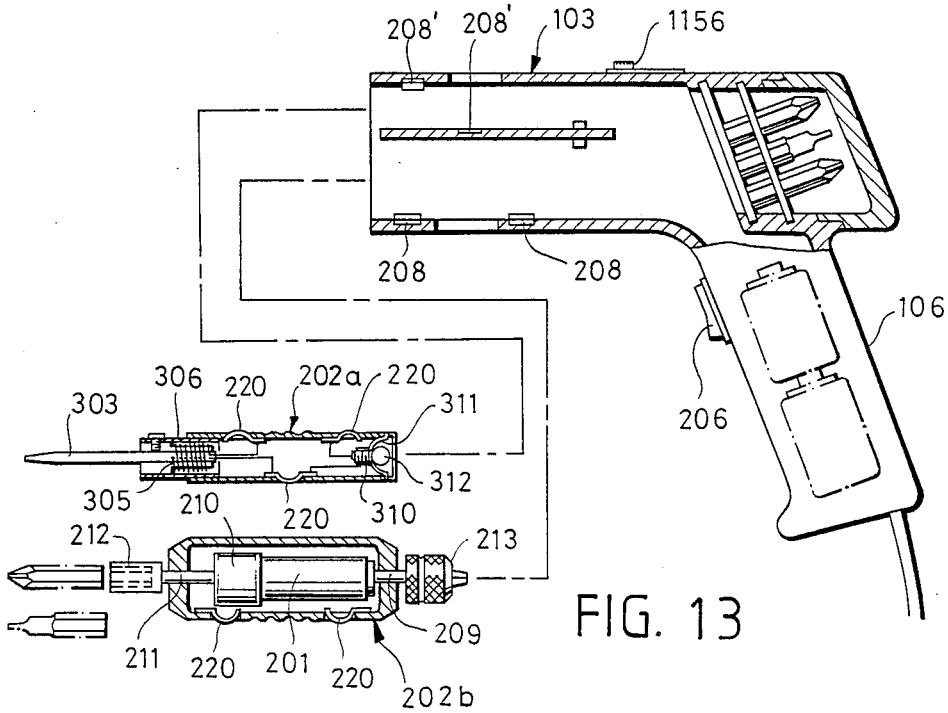
Figure 14A:
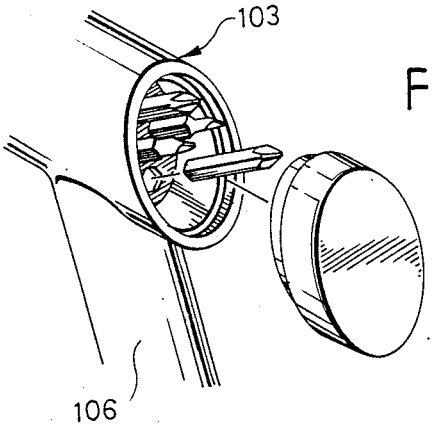
Figure 14:
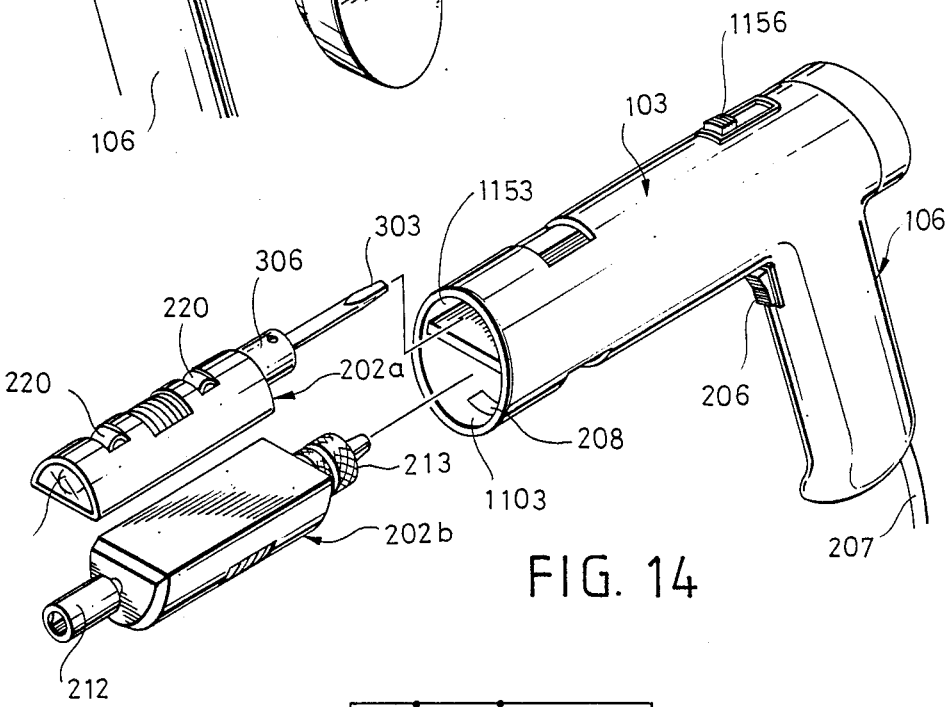
Figure 15:
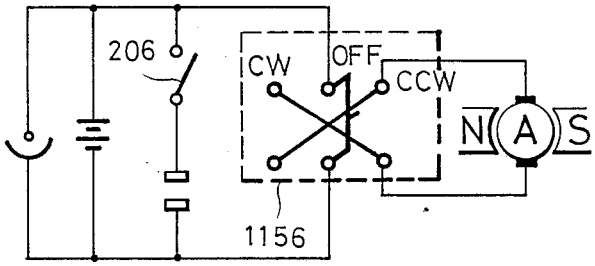
Figure 16:
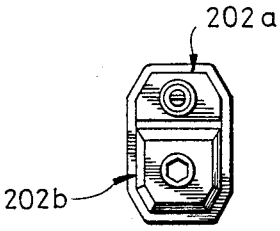
Figure 17:
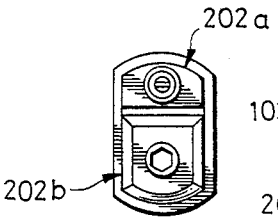

FIG. 6 a further possible configuration of module 202;

FIG. 7 shows a further possible configuration of module 202;

FIG. 8 is a perspective view showing a method of fixing module 202 within tubular portion 103;

FIG. 9 is a perspective view showing an alternative method of fixing module within tubular portion 103;

FIG. 10 is a perspective view showing a further possible method of fixing module 202 within tubular portion 103;

FIG. 11 is a side elevation of further embodiment of the invention;

FIG. 12 shows a further module which maybe used in electric appliances in accordance with the invention;

FIG. 14 is a perspective view of a further embodiment of the invention;

FIG. 14A is a view of the rear storage compartment of FIG. 14;

FIG. 15 is a wiring diagram of the embodiment of the embodiment of FIG. 14;

FIG. 13 is a side elevation, partly in section of the embodiment of FIG. 14;

FIG. 16 is an end elevation showing a variant of the embodiment of FIGS. 13 to 15;

FIG. 17 is an end elevation showing a further variant of this embodiment.

Figure 18:
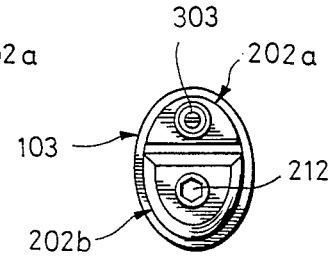

FIG. 18 is an end elevation showing yet another variant of this embodiment.

The hand tools shown in FIG. 1 comprises a handle portion 106 which is pivotally connected to a tubular portion 103, into which is releasably mounted an appliance module 202, in a manner which is described in detail with reference to FIG. 3 below. Rechargeable nickel cadmium cells 1 and 2 are held within handle 106 by a screw—in cap 3. The pivotal connection between handle 106 and handle portion 103 is provided by a lug 104 which extends within a split portion and is held therein by a bolt 108 whose shank 107 passes through hole 105 and a nut 111 which screws onto the threaded portion of the bolt. The head of the bolt fits within a hexagonal recess 102. The upper and lower surfaces of lug 104 are serrated and the inner surfaces of the split portion of tubular portion 103 are similarly serrated so that when the nut 111 and bolt 108 are tightened the engagements of the serrated surfaces locks the tubular portion 103 in a fixed orientation with respect to the handle 106. By unscrewing the nut 111 the split portions of the tubular portion 103 (which are resilient) can move apart slightly so that the angle between the handle 106 and tubular portion 103 can be adjusted.

Figure 3:
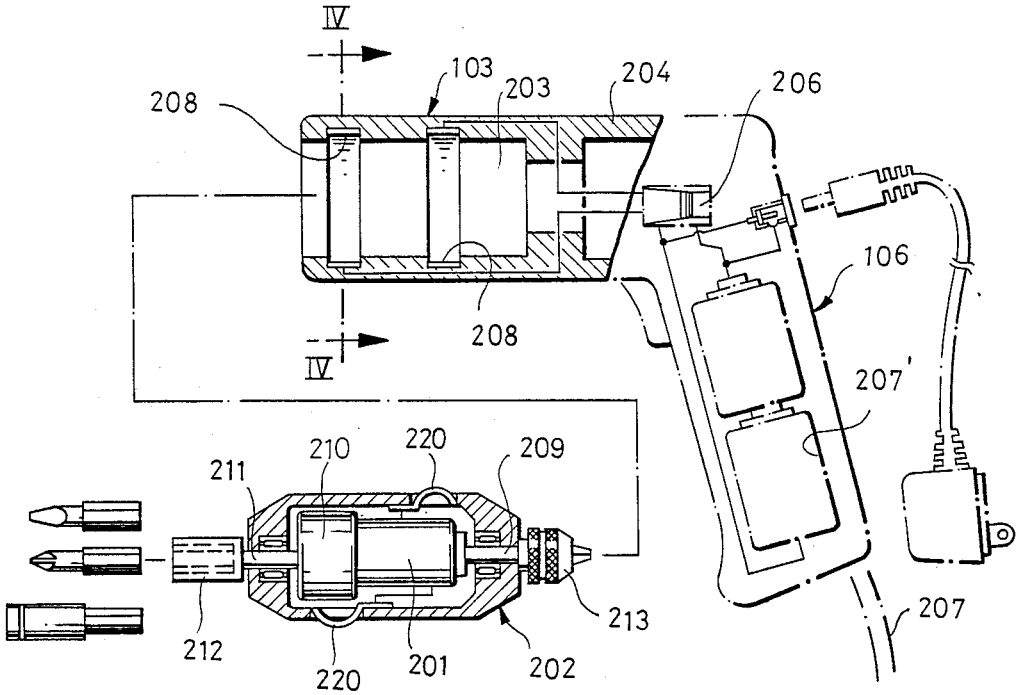
FIG. 3 is an elevation, partly in section showing a further embodiment of the invention.
Figure 4:
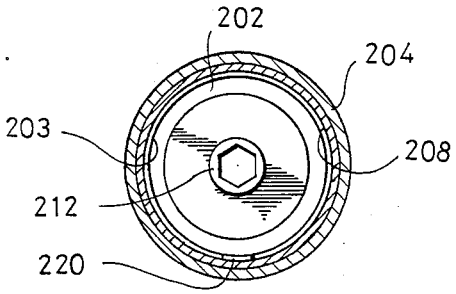
FIG. 4 is a section taken on IV—IV of FIG. 3.

Referring to FIGS. 3 and 4, an electric appliance module 202 is shown withdrawn from the interior 203 of the tubular portion 103 which extends from handle portion 106. As seen in FIGS. 3 and 4, two spaced-apart annular contacts 208 are provided and are received in two spaced-apart annular grooves in the interior 203 of the tubular portion 103. The contacts 208 engage respective spaced-apart power supply contacts 220 which in turn are connected to a motor 201 of module 202. Motor 201 is connected directly to a high speed output shaft 209 which carries a drill chuck 213 and is connected via a gear box 210 to a low speed output shaft 211 which carries a socket wrench 212. When the module 202 is inserted in tubular portion 103 a connection with a power source which maybe either a mains lead 207 or a battery assembly 207' can be established by operating a switch 206. If a battery assembly 207' is employed as the power source a socket (unreferenced) maybe provided on the exterior of handle 106 to enable the batteries to be recharged from a plug (unreferenced) attached to a DC supply.

Figure 5:
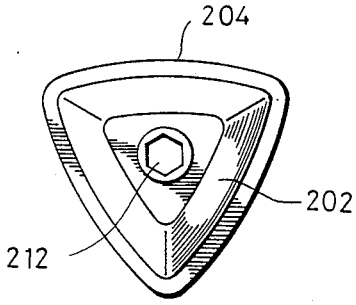
FIG. 5 is an end elevation showing an alternative configuration of the module 202.

Although the casing 204 of tubular portion 103 is shown as having a circular cross-section in FIG. 4, it may alternatively have a generally triangular configuration as shown in FIG. 5, a generally rectangular configuration as shown in FIG. 6 or a hexagonal configuration as shown in FIG. 7.

If a circular configuration is employed, a screw 231 maybe provided as shown in FIG. 8 which screws through the casing 204 of tubular portion 103 to engage module 202 and prevent it from rotating within tubular portion 103.

It can be appreciated by one skilled in the art, and from a review of FIGS. 3, 4 and 8, that the module 202 may be placed in the tubular portion 103 without regard to the circumferential orientation therebetween since the power supply contact 220 on the module 202 can engage the annular contacts 208 in the tubular portion 103 irrespective of orientation.

An alternative method of locking module 202 in position is shown in FIG. 9 which shows grooves 236 in tubular portion 103 which engage projections 235 (only one of which is shown) in module 202 to prevent it rotating.

A further possible arrangement is shown in FIG. 10 wherein diametrically opposed slots to 240 in the mouth of tubular portion 103 which enable the resulting split portions of this mouth to be forced together against the exterior of module 202 inserted therein when an undersized, preferably tapered ring nut 242 is screwed onto an exterior threaded portion of the mouth.

FIG. 11 shows a further embodiment in which module 202 carries a lamp bulb 312 in a holder 310 mounted on a reflector 311 at one thereof and a soldering iron 303 in a heat-proof holder 306 at its opposite end. The soldering iron is provided with a heating element 305 wound on an insulting member 304 and connected to the upper and bottom left hand pair (as shown in FIG. 11) of three contacts 220 on the exterior of the module. The lamp bulb 312 is connected between the upper contact 220 and lower right hand contact 220 (as shown). When the module 202 is inserted into tubular portion 103 in the orientation shown, only the upper contact 220 and the bottom left hand contact 220 engage the respective contacts 208 so that only the soldering iron is energised on activating switch 206. If however the module 202 is rotated 180° clockwise or anticlockwise before being inserted into tubular portion 103, only the contacts connected to lamp bulb 312 engage contacts 208 so that only the lamp bulb is energised.

FIG. 12 shows an alternative module which can be used in the embodiment of FIG. 11. This comprises a miniature vacuum cleaner whose motor is provided with contacts 220.

The embodiment shown in FIGS. 13,14 and 15 incorporates two appliance modules 202A and 202B which fit into upper and lower parts 1153 and 1103 of tubular portion 103 respectively. Module 202A carries a lamp bulb 312 mounted in a holder 310 on a reflector 311 at one end thereof and carries a soldering iron 303 mounted in a heat-proof casing 303 at the other end thereof. The element 305 of the soldering is connected to a lower and an upper lift contact 220 (as shown in FIG. 13) where as bulb 311 is connected to the lower and an upper right contact 220 (as shown). Accordingly, when module 202A is inserted in the orientation shown in FIGS. 13 and 14, the upper left and lower contacts 220 engage contact 208 prime and energise the soldering iron. Alternatively, if this module is inserted in the reverse orientation, only the contacts connected to lamp bulb 312 are energised. The lower module 202B incorporates a motor 201 which in connected to just two contacts 220 which accordingly engage contacts 208 when this module is inserted irrespective of whether a low speed shaft 211 carrying socket wrench 212 is exposed or the high speed output shaft 209 carrying drill chuck 213 is exposed. The motor 201 is connected directly to the high speed output shafts 209 and is connected via a step down gear box 210 to the low speed output shafts 211. A variety of screw-driver and other rotary tools can be fitted within socket wrench 212 as shown in FIG. 13; such tools are conveniently in a rear compartment of the handle portion as shown in FIG. 14A.

An on/off switch 206 is provided and a reversing switch 1156 is also provided to enable the direction of rotation of the output shafts of motor 201 to be reversed. The circuit diagram is shown in FIG. 15.

FIGS. 16,17 and 18 show various non-circular configurations of the modules 202A and 202B which may be fitted within correspondingly shaped tubular portions 103 of similarly non-circular configuration.

It will be appreciated that since the modules 202A and 202B are non-circular in cross-section, it is not necessary to provide any screw locking means as shown in FIG. 8 to prevent them from rotating. However, it may be desirable to provide some releasable gripping means to prevent them from being withdrawn inadvertently from tubular portion 103. A variety of electric tools may be provided in modular form for insertion into tubular portion 103, such as electric brushes, electric shaping and grinding tools, electric polishing tools and the like. The embodiment of FIGS. 13 to 15 has the advantage that the two exposed appliance portions such as the lamp bulb 312 and drill chuck 213 (when the modules shown in FIG. 13 are reversed in orientation before insertion) may cooperate. Thus the lamp bulb 312 may be arranged to illuminate the area of a hole drilled by a drill held in drill chuck 213.

Figure 1:
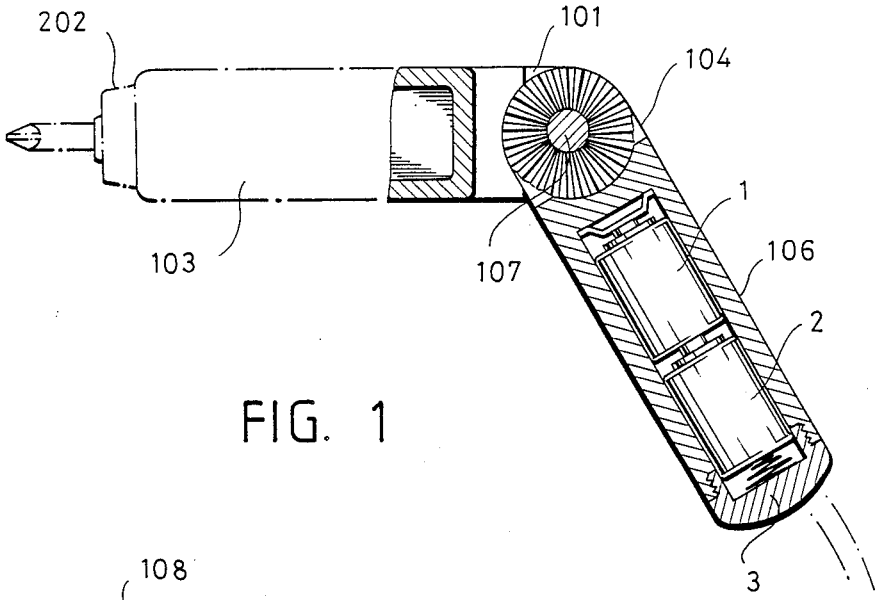
FIG. 1 is an elevation, partly in section of hand held electric tool in accordance with the invention.
Figure 2:
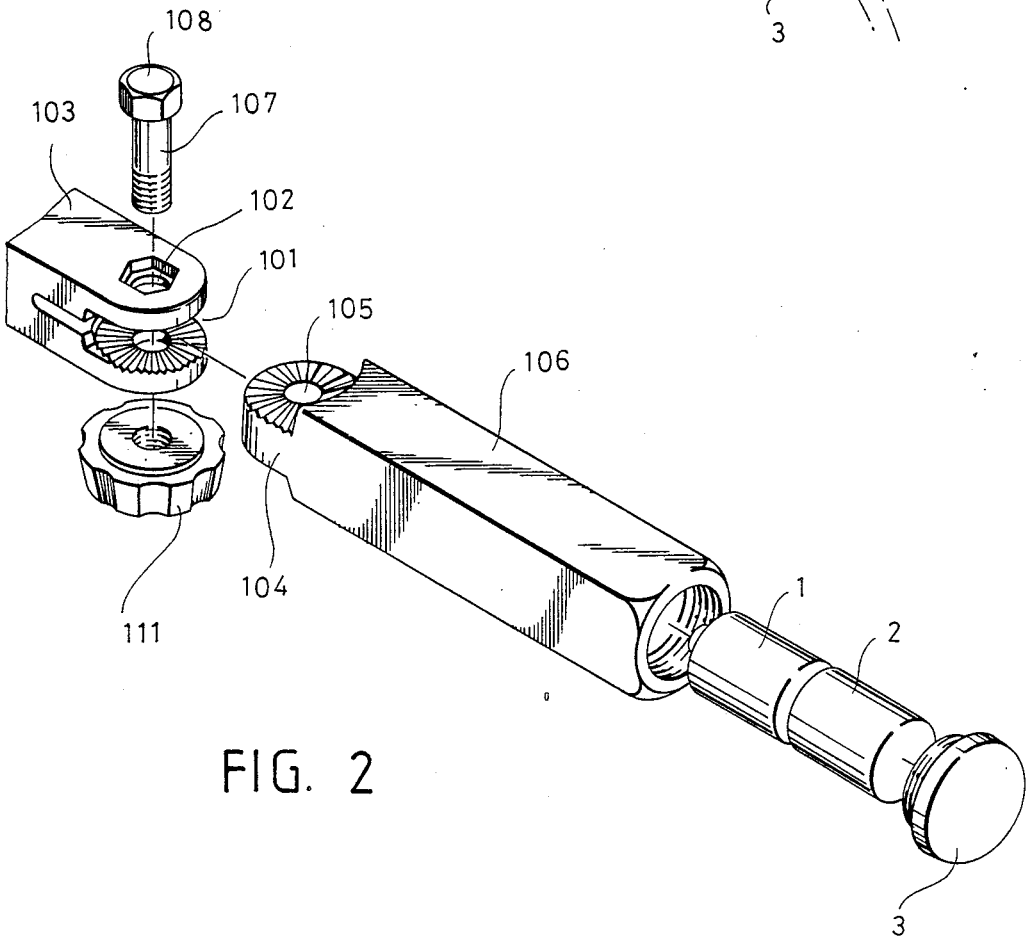
FIG. 2 is an explodes perspective view showing the connection between the handle and tubular portion of the tool of FIG. 1.

The feature of the adjustable locking of the angle between the handle portion 106 and the other portion 103 as disclosed in FIGS. 1 and 2 is a separate feature of the invention and is not necessarily limited to the features of claim 1. Thus in another aspect, the invention provides a hand held electric tool in which the angle between the a handle portion and a body portion thereof may be adjusted.

I claim:

1. A hand-held electric appliance comprising a housing having a handle portion and further having a generally cylindrical tubular portion extending forwardly of the handle portion, the cylindrical tubular portion having mounted therein a pair of axially spaced-apart power supply contacts, each of said power supply contacts comprising a substantially annular band, respective conductors connecting the annular bands and a power supply means, an electric appliance module being releasably mounted within said tubular portion and incorporating an electric appliance portion which is connected to further contacts located on the exterior of the appliance module, said further contacts being spaced-apart axially on said electric appliance module and engaging said axially spaced-apart power supply contacts when said module is inserted into the tubular portion of the housing, such that the module may be inserted into the tubular portion without regard for the relative circumferential orientation therebetween.

2. An appliance as claimed in claim 1 wherein said appliance module carries (202) at least three of said further contacts (220) which are so connected and disposed that only the exposed appliance portion (212,213,303,311,312,1151) is energised from said power supply contacts.

3. A hand-held electric appliance comprising a housing having a handle portion and further having a generally cylindrical tubular portion extending forwardly of the handle portion, the cylindrical tubular portion having mounted therein a pair of axially spaced-apart power supply contacts, each of said power supply contacts comprising a substantially annular band, respective conductors connecting the annular bands and a power supply means, two electric appliance modules being releasably mounted within said tubular portion each incorporating an electric appliance portion which is connected to further contacts located on the exterior of the appliance module, said further contacts being spaced-apart axially on said electric appliance module and engaging said axially spaced-apart power supply contacts when said module is inserted into the tubular portion of the housing, such that the module may be inserted into the tubular portion without regard for the relative circumferential orientation therebetween; and the appliance modules comprising a first module and a second module, said modules being releasably located side by side, each of said modules having a respective appliance portion exposed simultaneously.

4. An appliance as claimed in claim 3 wherein one of said exposed appliance portions is a light which is arranged to illuminate the area operated on by the other exposed appliance portion.

* * * * *